US007328590B2

(12) United States Patent
Sherlock

(10) Patent No.: US 7,328,590 B2
(45) Date of Patent: Feb. 12, 2008

(54) CORROSION RESISTANT EVAPORATIVE COIL FOR REFRIGERATION SYSTEM

(75) Inventor: Russell Sherlock, Toronto (CA)

(73) Assignee: Habco Beverage Systems, Inc., North York, Ontario (CA)

( * ) Notice: Subject to any disclaimer, the term of this patent is extended or adjusted under 35 U.S.C. 154(b) by 273 days.

(21) Appl. No.: 11/052,133

(22) Filed: Feb. 8, 2005

(65) Prior Publication Data

US 2006/0000230 A1 Jan. 5, 2006

(30) Foreign Application Priority Data

Jun. 30, 2004 (CA) ..... 2472874

(51) Int. Cl.
*F25B 47/00* (2006.01)

(52) U.S. Cl. ..... 62/305

(58) Field of Classification Search ..... 62/277, 62/305, 513, 515
See application file for complete search history.

(56) References Cited

U.S. PATENT DOCUMENTS 5,848,536 A * 12/1998 Dodge et al. ..... 62/240
6,134,903 A * 10/2000 Potnis et al. ..... 62/271
6,216,489 B1 * 4/2001 Potnis et al. ..... 62/497
6,318,904 B1 * 11/2001 Reichle ..... 385/78
6,477,846 B2 * 11/2002 Yundt, Jr. ..... 62/71

* cited by examiner

*Primary Examiner*—Melvin Jones
(74) *Attorney, Agent, or Firm*—Jon L. Woodard, Esq.; Edward W. Goebel, Jr., Esq.; MacDonald Illig Jones & Britton

(57) ABSTRACT

An evaporative coil for a condenser assembly in a refrigeration system, the evaporative coil having a portion of its length received in a tubular cladding made of corrosion resistant material, for example, stainless steel.

9 Claims, 3 Drawing Sheets

CORROSION RESISTANT EVAPORATIVE COIL FOR REFRIGERATION SYSTEM

FIELD OF INVENTION

This invention relates to refrigeration systems and in particular relates to the evaporative coil which forms part of the condenser assembly that feeds condensate from the compressor to the condenser and in particular, a portion of the evaporative coil which lies inside the condensate pan.

BACKGROUND OF THE INVENTION

The evaporative coil carries coolant from the compressor to the heat-exchanging condenser so that coolant can ultimately be condensed to a liquid and returned to the evaporator assembly in a refrigeration system. Because of compression, the coolant is actually very hot and hot coolant flowing through the evaporative coil is normally used to assist in the evaporation of any condensed moisture collected in a condensate pan including liquids and condensed water vapour drained from the refrigerated interior of an associated cabinet. Conversely, condensed moisture emerging from an evaporator assembly which collects in the condensate pan can be used to define a pre-cooling stage so as to assist in cooling gaseous coolant in the evaporative coil emerging from the compressor prior to entry into a heat-exchanging condenser.

A problem which arises with such an arrangement is that contact between the evaporative coil and moisture in the condensate pan results in corrosion in the evaporative coil which normally is a bent piece of copper tubing. Copper is a material of choice because it is inexpensive, it is heat conductive, and easy to form and weld.

An object of this invention is to minimize corrosion of the bare copper tubing used as an evaporative coil in a refrigeration system.

SUMMARY OF THE INVENTION

In accordance with this invention there is provided an evaporative coil for a condenser assembly in a refrigeration system, the evaporative coil having a portion of its length received in a tubular cladding made of corrosion resistant material. Preferably the cladding is stainless steel and the portion of the evaporative coil which is received in cladding is bent for location in a condensate pan.

BRIEF DESCRIPTION OF THE DRAWINGS

In order that the invention can be better understood, a preferred embodiment is described with reference to the accompanying drawings.

DESCRIPTION OF PREFERRED EMBODIMENT WITH REFERENCE TO DRAWINGS

Figure 1:
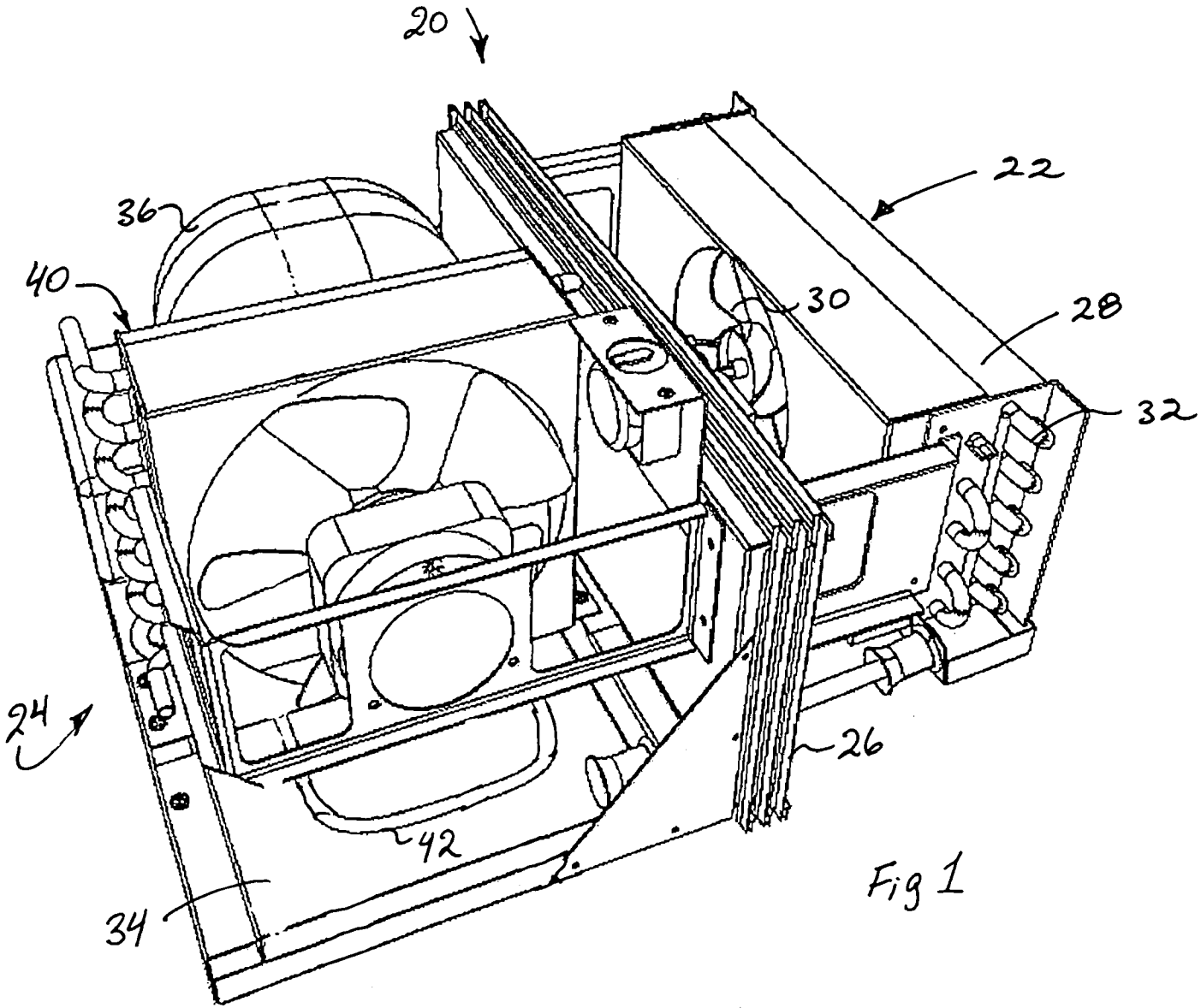
FIG. 1 is a perspective view of a refrigeration system.
Figure 2:
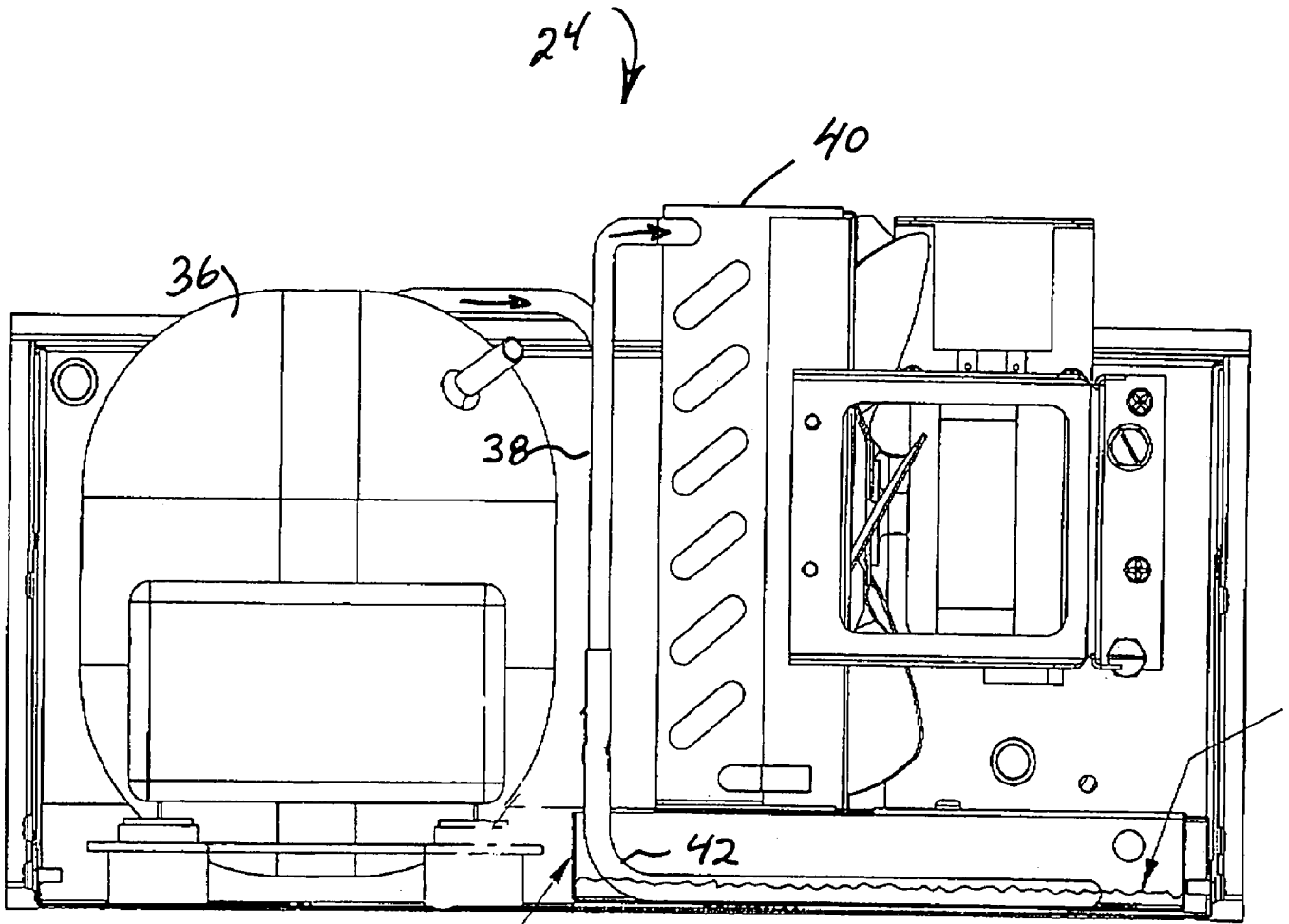
FIG. 2 is a side elevational view of a condenser assembly forming part of the refrigeration system of FIG. 1.
Figure 3:
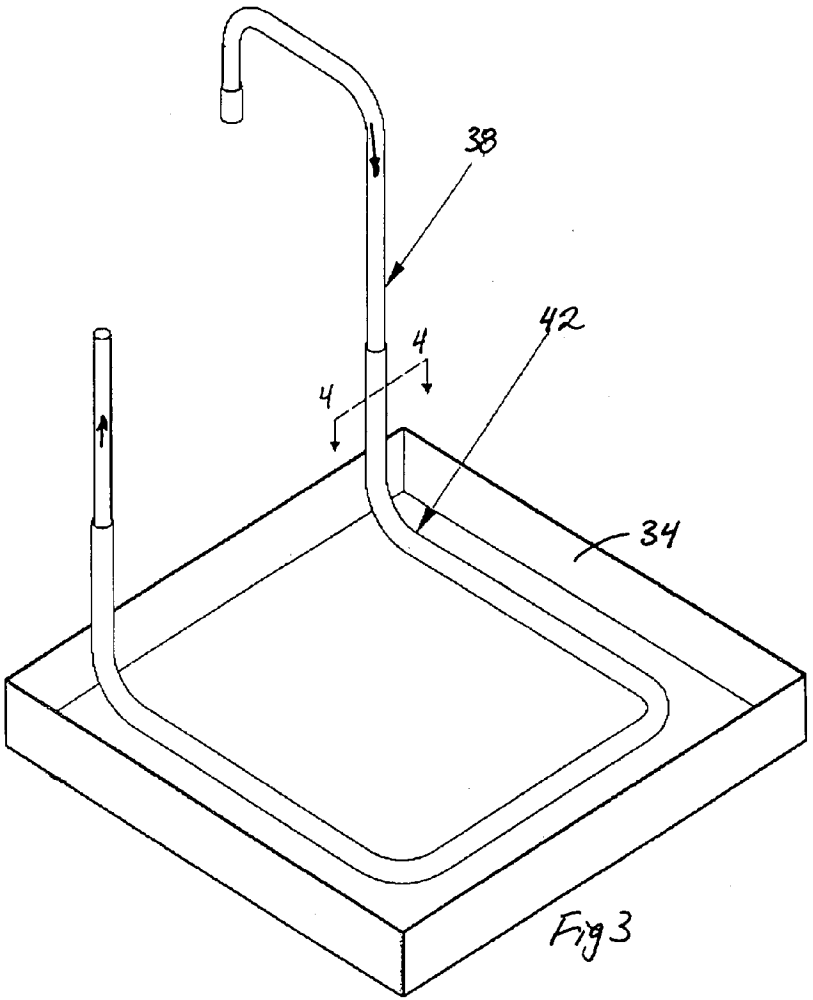
FIG. 3 is a perspective view of an evaporative coil made in accordance with the invention and associated condensate pan.

A refrigeration system is generally indicated in FIG. 1 by reference numeral 20. The refrigeration system 20 consists of an evaporator assembly 22 (drawn to the right of FIG. 1) and a condenser assembly 24 (drawn to left of FIG. 1) and disposed on opposite sides of a bulkhead 26.

The evaporator assembly 22 consists of an evaporator 28 associated with a fan 30 which forces cool air from the evaporator into a refrigerated compartment (not shown). Return air from the refrigeration cabinet is also aspired by the evaporator fan 30 into an insulated compartment which would contain the evaporator assembly 22. By virtue of its function, an evaporator coil 32 forming part of the evaporator 28 is very cold and inevitably any moisture carried by return air is condensed when it reaches the insulated compartment for the evaporator assembly 22. Effectively, the evaporator coil 32 operates to dehumidify air in the refrigerated portion of any associated cabinet. An evaporator pan (not shown) and disposed beneath the evaporator assembly 22 collects any condensed moisture dripping from the evaporator coil 32 and is drained into a condensate 34 on the other side of the bulkhead 26 and forming part of the condenser assembly 24. Coolant is circulated in a closed circuit between the evaporator assembly 22 and the condenser assembly 24, leaving the evaporator coil 32 as a gas for compression in a compressor 36. The coolant leaves the compressor 36 through an evaporative coil 38 of which a portion has a path inside the condensate pan 34 where the evaporative coil 38 will come into contact with condensate drained from the evaporator 28. The evaporative coil 38 supplies a heat-exchanging condenser 40 where coolant is ultimately condensed to a liquid before being returned to the evaporator assembly 22.

It is the portion of the evaporative coil 38 which comes into contact with condensate in the condensate pan 34 which is the subject of this invention. Because the evaporative coil which commonly is made of copper tubing is immersed in water or partially immersed in water it is subject to pitting and general corrosion which can damage the coil and result in the loss of coolant from the refrigeration system.

In accordance with the invention, the copper tube forming the evaporative coil 38 is clad with a corrosion resistant covering over a portion of its length which includes the portion which normally is disposed inside the condensate pan 34 and is exposed to condensate or water. In accordance with a preferred embodiment of the invention, the copper tube forming the evaporative coil 28 is clad with stainless steel tubing indicated by reference numeral 42 in the drawings. Stainless steel is a material of choice because of its resistance to corrosion and inherent heat conductivity. However, it will be understood by those skilled in the art that other materials resistant to corrosion may equally be suitable provided there is sufficient heat conductivity to evaporate condensate in the condensate pan 34. It will be observed that the clad portion of the evaporate coil has a bent shape which in the embodiment illustrated traces three sides of a quadrilateral before emerging from the condensate pan 34. However, it will be understood that other shapes sometimes including a serpentine path may be given to this portion of the evaporative coil 38.

Figure 4:
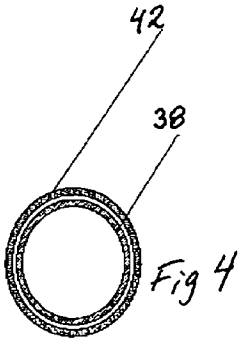
FIG. 4 is a cross-sectional view (drawn to a larger scale) on line 4-4 of FIG. 3.

In order to fabricate the evaporative coil in accordance with the invention, a selected length of copper tubing would be inserted into a smaller length of stainless steel tubing (as shown in FIG. 4), the position of the copper tubing 38 and stainless steel cladding 42 relative to each other would be fixed and then the assembled tubing would be bent over a mandrel in conventional fashion to form the desired shape required to lead the evaporative coil 38 through the condensate pan 34.

Thus it will be understood that the stainless steel cladding 42 is the only portion of the evaporative coil 38 which comes into physical contact with condensate in the condensate pan and therefore protects the copper tubing 38 disposed inside the cladding from corrosion.

It will be understood that several variations may be made to the above-described embodiment of the invention within the scope of the appended claims. In particular, it will be understood that the nature of the materials used, namely copper and stainless steel for the evaporative coil and cladding respectively, may vary in accordance with availability and cost.

The invention claimed is:

1. An evaporative coil for a condenser assembly in a refrigeration system, the evaporative coil having a portion of its length received in a tubular cladding made of corrosion resistant material.

2. An evaporative coil according to claim 1 where the tubular cladding is made of stainless steel.

3. An evaporative coil according to claim 1 where the portion of the evaporative coil received in cladding is bent for location in a condensate pan.

4. A refrigeration system having an evaporator assembly and a condenser assembly, the condenser assembly having an evaporative coil for receiving coolant from a compressor and delivering coolant to a condenser, the coolant being circulated in a closed loop between the evaporator assembly and the condenser assembly, the evaporative coil having a portion of its length disposed in a condensate pan for receiving condensate, said portion of the evaporative coil being received in a tubular cladding made of corrosion resistant material.

5. Refrigeration system according to claim 4 in which the cladding is made of stainless steel.

6. Refrigeration system according to claim 4 in which the evaporative coil is bent into a serpentine shape for location in the condensate pan.

7. A method of making an evaporative coil in which a first length of copper tubing having an outer diameter is disposed inside a second length of stainless steel tubing having an internal diameter which exceeds said outer diameter, said second length being selected to extend throughout a portion of the evaporative coil which in use will lie inside a condensate pan, and bending said copper tubing with stainless steel cladding to a pre-defined shape suitable for being received in said condensate pan.

8. An evaporative coil for a condenser assembly in a refrigeration system, the evaporative coil having a portion of its length received in a tubular cladding made of corrosion resistant material, wherein the portion of the evaporative coil received in cladding is bent for location in a condensate pan.

9. An evaporative coil according to claim 8 wherein the tubular cladding is made of stainless steel.

* * * * *